United States Patent [19]

Keenan et al.

[11] Patent Number: 4,616,370

[45] Date of Patent: Oct. 14, 1986

[54] FURNITURE

[76] Inventors: Phillip R. Keenan; Anthony F. Keenan, both of 48 Ethel Street, East Brunswick, Victoria 3057, Australia

[21] Appl. No.: 680,803

[22] Filed: Dec. 12, 1984

[30] Foreign Application Priority Data

Dec. 13, 1983 [AU] Australia ..... PG2820/83

[51] Int. Cl.[4] ..... A47B 83/00; A47D 11/00

[52] U.S. Cl. ..... 5/2 R; 5/3; 5/12 R; 5/28; 5/36

[58] Field of Search ..... 5/2 R, 3, 6, 12 R, 28, 5/35, 36, 37 R, 41, 42, 53 R, 53 B, 174, 175, 177; 297/363

[56] References Cited

U.S. PATENT DOCUMENTS

| | | | |
|---|---|---|---|
| 1,224,982 | 5/1917 | Washeim | 5/37 R |
| 1,926,915 | 9/1933 | Ramirez | 5/35 |
| 2,031,124 | 2/1936 | Perlesz et al. | 5/37 R |
| 2,771,124 | 11/1956 | Borsani | 297/363 |
| 3,085,257 | 4/1963 | Laemmle | 5/35 |
| 3,952,344 | 4/1976 | Cycowicz et al. | 5/35 |
| 4,506,927 | 3/1985 | Lombardo | 5/3 |

FOREIGN PATENT DOCUMENTS

| | | | |
|---|---|---|---|
| 2509069 | 9/1976 | Fed. Rep. of Germany | 5/3 R |
| 2488116 | 2/1982 | France | 5/28 |
| 216432 | 5/1924 | United Kingdom | 5/35 |

*Primary Examiner*—Gary L. Smith
*Assistant Examiner*—Michael F. Trettel
*Attorney, Agent, or Firm*—Larson & Taylor

[57] ABSTRACT

An article of furniture having three panels each of which has a pair of spaced members which are interconnected by transverse members, two pairs of spaced members being interconnected by pivots and the other pairs of spaced members being interconnected by hinge on the outermost transverse members, the arrangement being such that the article can adopt a number of positions to be useable as a bed, seat or table.

5 Claims, 7 Drawing Figures

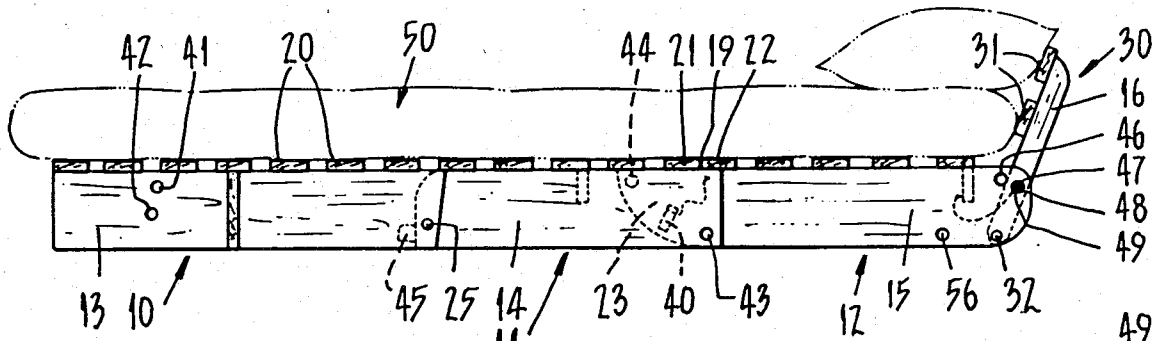
FIG. 3.
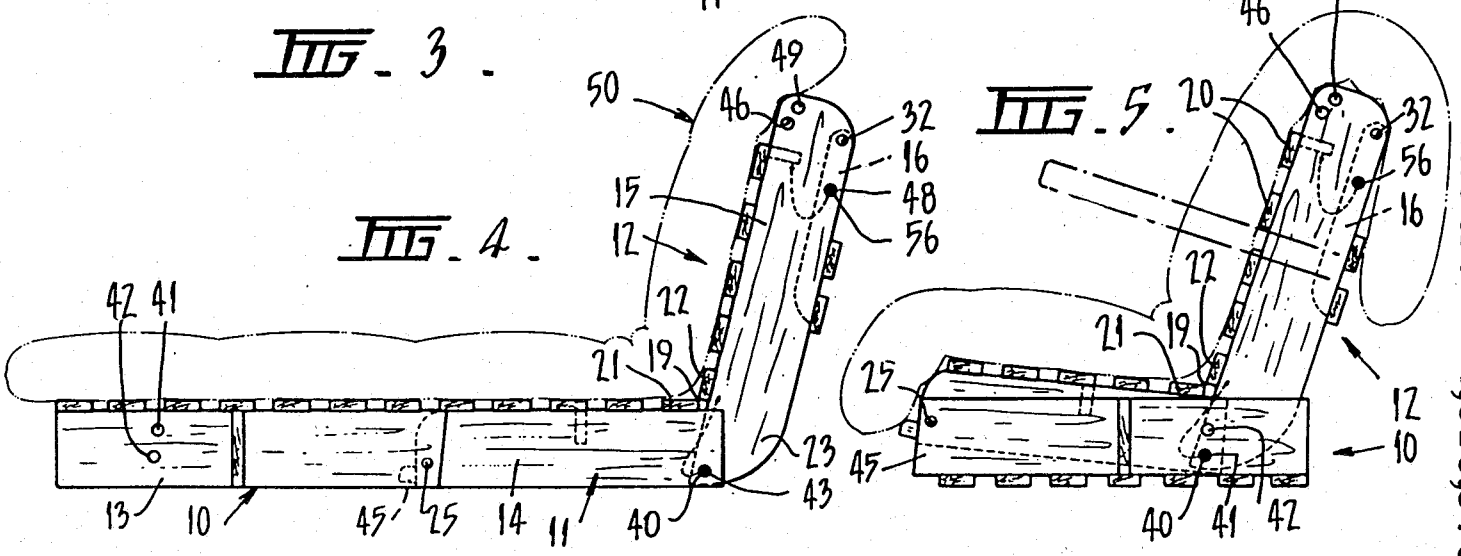
FIG. 4.
FIG. 5.

FURNITURE

This invention relates to improvements in furniture and, in particular, to an improved article of furniture which can have a number of uses.

Generally, the type of furniture to which the invention relates is that which comprises spaced frame members which are interconnected preferably by transverse members which may be spaced slats.

Such items of furniture can be designed for use, for example, as a bed with a futon which is a Japanese type mattress or any mattress designed to be folded.

Whilst beds of this general type have been provided and, on some occasions, the beds can be caused to adopt a second position in which they can act as a sofa or the like, such furniture is not greatly versatile and it is normally difficult to store when not in use.

The principal object of the present invention is to provide an article of furniture which can be used in various configurations and which can be folded to occupy a relatively small volume when not being used.

The invention, in its broadest sense, includes an improved article of furniture comprising three panels, each of which has a pair of spaced members which are interconnected by transverse members or the like, one end panel being pivotally connected to an intermediate panel by pivots passing through the spaced members, the other end panel being connected to the intermediate panel by hinging the outermost slats, the arrangement being that the panels can be located at different orientations to each other.

Preferably to the free end of the end panel which is connected to the intermediate panel by hinging the slats of the panels there is a further panel which is small relative to the other panels.

In order that the invention may be more readily understood, we shall describe one embodiment of the invention, together with the mode or modes of use, the description being in relation to the accompanying drawings, in which:

FIG. 3 is a side elevation view of the article in its extended position;

FIG. 4 is a view of the article where one of the panels is folded upwardly;

FIG. 5 is a view where the article is in a position where it is useable as a chair;

Figure 1:
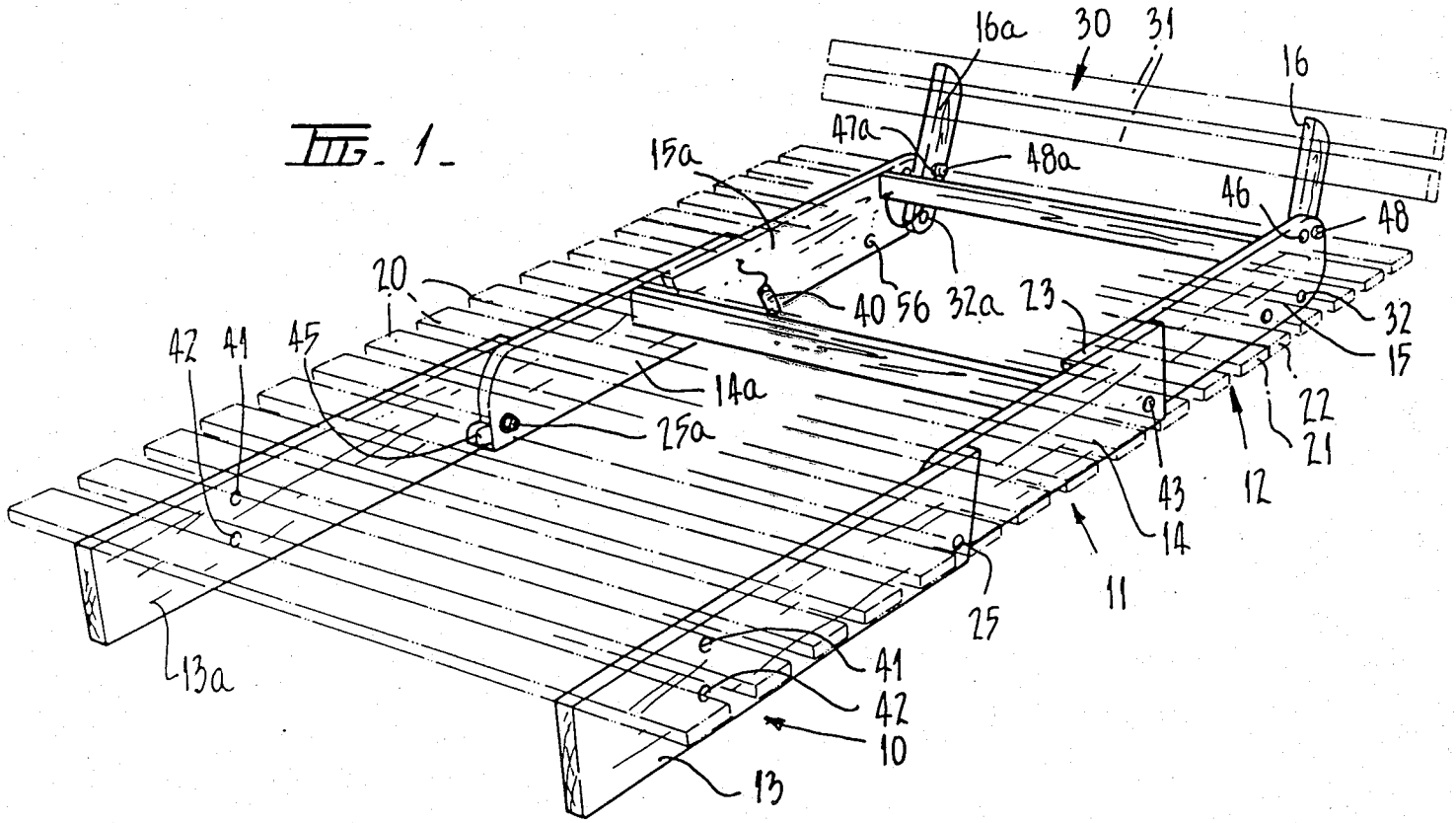
FIG. 1 is a perspective view of the article of furniture as a bed, with some of the components in chain-dash to enable ready understanding, with the bed in its useable position.

In the illustrated form of the invention, as we previously indicated, there are three panels 10, 11, 12, each of which may be of different lengths and widths but which are such that, when the three panels are connected end to end they provide a surface which can be used as a bed. The bed may be of the size of a single or double bed or even larger sizes, such as a queen or king size bed.

Each panel comprises a pair of spaced members 13, 13*a*, 14, 14*a*, 15, 15*a* each of which may be substantially higher than its width and each pair of which are connected by a number of slats 20. The arrangement is such that when the panels are connected one to another, the spaced members cause the slats to be spaced from the floor and are so located to provide a surface which can be of satisfactory height for a low bed.

The spacing of the spaced members is such that the members 13, 13*a* are spaced apart wider than those of the other two panels, those members 14, 14*a* of the intermediate panel are spaced as to be relatively closely received within the members 13, 13*a* and members 15, 15*a* of the other end panel are spaced as to be received within the members 14, 14*a*.

We shall refer to the panel 10 which has the widest spacing as being the foot panel and the end panel 12 having the narrowest spacing as being the head panel.

The foot panel 10 and intermediate panel 11 are interconnected by a pivotal connection 25 at each side, the connections being through the spaced members, substantially towards the bottom thereof, the distance from the bottom being the same for each panel.

In each case the slats 20 terminate relatively close to the ends of the panels so that when the foot panel and the intermediate panel lie with their slats in the same plane, then the spacing of the slats is substantially equidistant therealong. This can readily be seen from FIGS. 3 and 4.

The connection between the intermediate panel 11 and the head panel 12 is somewhat different as, in this case, whilst the intermediate panel 11 has its end slat 21 relatively close to its end, the head panel has end portions 23 of its spaced members extending substantially from the end slat 22 and, in this case, the pivotal connection is between the outermost slats 21, 22 of each of the panels and, preferably, connection may be by piano hinges 19 or the like extending along a substantial part of the length of the slats.

In this case, when the two panels are oriented so that the slats are in the same plane, the ends 23 of the spaced members 15, 15*a* of the head panel extend substantially along the spaced members 14, 14*a* of the intermediate panel and lie just beneath the underside of the slats of the intermediate panel.

A fourth, smaller panel 30, which has two spaced members 16, 16*a*, may have only two slats 31 and which may comprise a bed head, can be pivotally connected to the free end of the head panel, adjacent the lower surface thereof, at pivots 32, 32*a*.

This panel, again, is formed so that its spaced members 16, 16*a* comprise arms which extend between the spaced members 15, 15*a* of the head panel and these arms may be relatively narrow.

The article of furniture described can be caused to adopt a number of different orientations and these, together with the ways of maintaining the orientations, will now be described.

Figure 2:
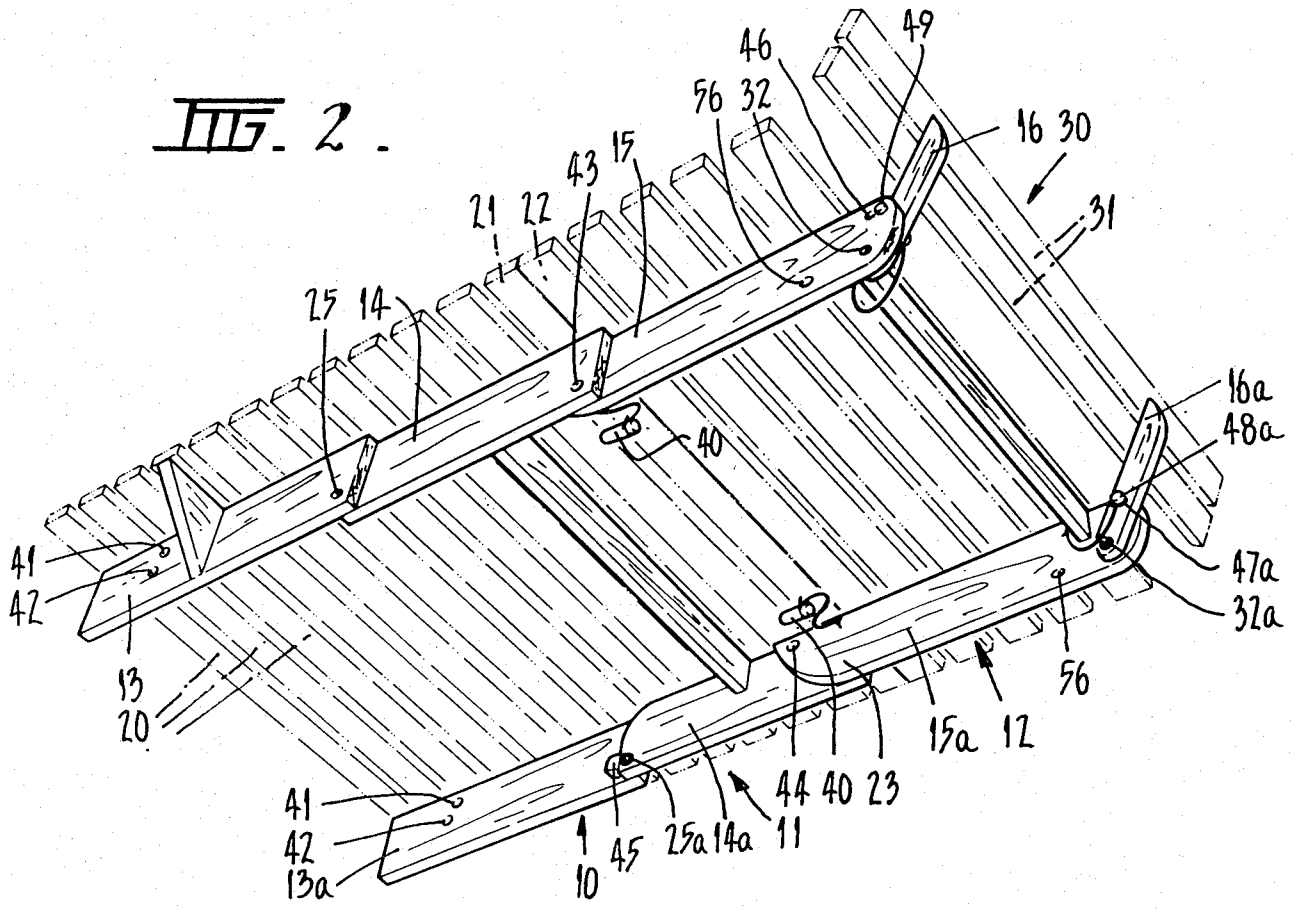
FIG. 2 is an underneath perspective of the article in the same condition as in FIG. 1.

As can be understood from the foregoing, when each of the three panels lie with the upper surface of their slats 20 in the same plane, and as illustrated in FIGS. 1 to 3, the spaced members extend downwardly the same amount and, thus, these can all be resting on the floor with the slats forming a flat bed base or the like. Because of the location of the adjacent slats between the foot panel 10 and the intermediate panel 11, there is little space between these and, because the adjacent slats of the intermediate panel 11 and the head panel 12 are, in fact, hinged together by hinge 19, there is no spacing at all between these and, thus, the article of furniture provides a good base for a futon or a foldable mattress 50.

We prefer to provide means whereby either or both the head and foot panels can be located and held in a position away from the horizontal. This can be useful for persons suffering from diseases where it is desirable that the head or feet be raised.

The arrangement of the various panels permit the article to be folded to a position where it can be stored, occupying a minimal amount of space and it so happens that the same position may permit the article to be used as a desk or the like.

Figure 6:
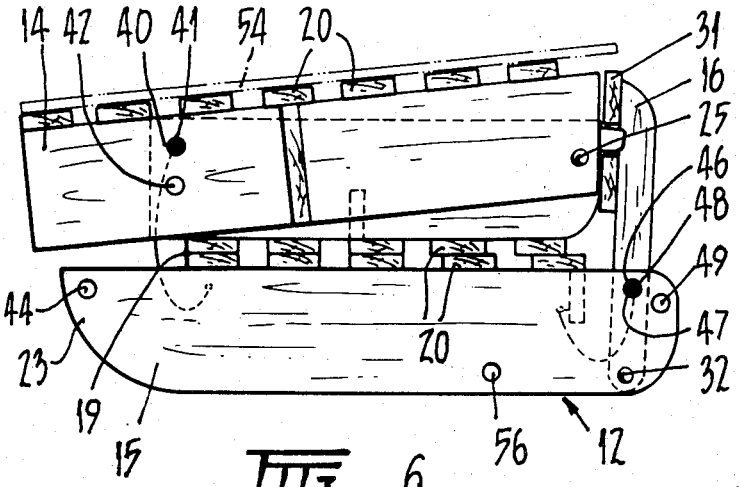
FIG. 6 is a view where the article of furniture is useable as a desk for a kneeling user.

This position is illustrated in FIG. 6.

It will be seen that, because of the location of the pivots 25, 25*a* the foot panel 10 and the intermediate panel 11 can be folded so that they overlap and occupy a total width only slightly greater than the width of the spaced members 13, 14.

These members so folded can then be rotated about the piano hinge 19 between the slats 21, 22 so that the slats on the intermediate panel 11 come into contact with the slats on the head panel 12.

It will be seen that, in this condition, the article occupies a minimal amount of space.

The panel 30 comprising the head can be moved inwardly so as to abut the ends of the intermediate panel 11 and foot panel 10.

In order to readily maintain the article in this configuration, we provide a pair of apertures 43, one in each member 14, 14*a* and a corresponding pair of apertures 41 in the members 13, 13*a*.

Adjacent the apertures 41 there are a pair of apertures 42, also in the members 13, 13*a* which will be described hereinafter.

When the foot panel 10 and the intermediate panel 11 are in the position illustrated in FIG. 6, a peg or the like 40, which may be tethered to the head panel 12 can be passed through the apertures 43, 41 which are in alignment and this prevents relative rotation between the foot panel 10 and the intermediate panel 11.

On the ends of the members 14, 14*a* of the intermediate panel, connected to the foot panel 10, there are extensions 45 and the width of these extensions are substantially the same as the spacing between the two slats 31 of the fourth panel 30 and, when the three main panels are folded, the panel 30 may be rotated inwardly about its pivots 32, 32*a* so that there is interengagement between the extensions 45 and the space between the slats 31 and, in this case, there are apertures 46, 46*a* in the head members 15, 15*a* which come into alignment with apertures 47, 47*a* in the members 16, 16*a* of the panel 30 and pegs or the like 48, 48*a* can pass through these apertures to then retain the article in its folded condition.

There is a second aperture 49 in each member 15, 15*a* which normally acts, in association with the apertures 47 and the pegs 48 to retain the panel 30 in the condition shown in FIGS. 1 to 3.

Thus, the whole article of furniture folds up to the approximately cuboidal form illustrated in FIG. 6 which is relatively simple to handle.

The article can be used as a TV lounge in which the intermediate and foot panels are outwardly directed and the head panel is at an angle to form a sloping back. This is the condition illustrated in FIG. 4.

In order to obtain this configuration, we provide apertures 44 through the portion of the spaced members of the head panel which overlie the spaced members of the intermediate panel, together with the corresponding apertures 43 through the spaced members of the intermediate panel. When the two panels are in the required angular orientation, we then pass the wooden pegs 40 or the like through these apertures to maintain this orientation.

In this orientation, it is preferred to move the panel 30 so that it causes as little obstruction as possible and to do this it is rotated about its pivots 32, 32*a* until it lies substantially within the members 15, 15*a* of the head panel 12 and we prefer to provide apertures 56 in the members 15, 15*a* with which the apertures 47 in the members 16, 16*a* can be aligned and the member can be held in this position by use of the pegs 48.

When so arranged, the futon or foldable mattress 50 can be located over the panels to provide a satisfactory article of furniture, as can be seen in FIG. 4.

The article can also be used as a sofa. This arrangement is illustrated in FIG. 5. In this case the orientations between the head panel 12, the intermediate panel 11 and the panel 30 are as described hereinabove and the foot panel 10 is rotated relative to the intermediate panel so that the two panels are in an overlying relationship. That is the slats of the foot panel rest on the floor and provide the base of the sofa.

In this case, if it is required, and it is preferred, the seat of the sofa slopes rearwardly from the front to the junction with the back and it may be desirable to provide the apertures 41 in the required position in the spaced members of the foot panel to co-operate with the pegs 40 passing through the apertures in the intermediate panel and the head panel and the required orientation can be achieved.

If required, in the orientation of FIGS. 4 and 5, more than one such aperture can be provided to give different angular locations.

Illustrated in chain dash lines in FIG. 5 is an arm rest which may be removeably attached to the article either in the orientation of FIG. 4 or FIG. 5. The means of attachment can be by pegs or in any other way.

It is possible, also, to use the article of furniture as a low desk. This is the folded condition previously described and illustrated in FIG. 6. In this case the panels are folded one over the other with the head panel being downwardly directed and the slats of the foot panel being upwardly directed and providing the surface of the desk.

In this arrangement, because the pivots 25 between the intermediate panel 11 and the foot panel 10 are off centre and spaced adjacent the lower edges of the spaced members, there is a downward slope of the upper surface of the foot panel.

Figure 7:
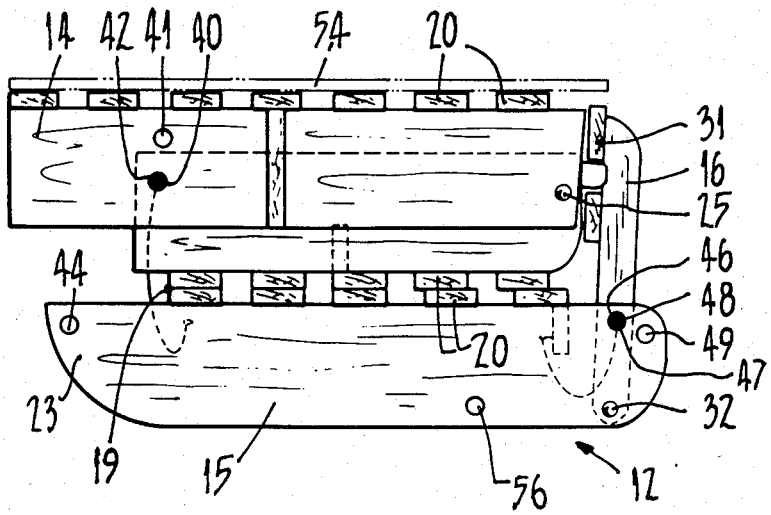
FIG. 7 is a view showing the article in a condition where it can be used as a table.

The article can also be used as a low table and this is illustrated in FIG. 7. The arrangement is achieved by adjusting the orientation between the intermediate panel and the foot panel relative to the position it was in in the desk orientation and this is best done by providing the apertures 42 in the spaced members of the foot panel which correspond with the apertures 43 in the spaced members of the intermediate panel adjacent the point of connection with the head panel, previously described, such that, when the pegs 40 or the like are passed through the apertures, the orientation of the foot panel is horizontal.

We may provide a flat surface 54 which can lie over the foot panel and provide a solid top of the desk or the table when the article is to be used in these configurations.

We claim:

1. In an article of furniture convertible into a bed, lounge, chair, or table, said article having interconnected intermediate and first and second end panels, each of which has a pair of spaced longitudinal members which are connected by a plurality of transverse slots, said first end panel being pivotally connected to one end of said intermediate panel by pivot means, said second end panel connected to the other end of said intermediate panel by hinge means connected between the transverse slats at the adjacent ends of said panels, said article being constructed and arranged so that said panels can be located in different angular positions relative to each other to form said bed, lounge, chair, or table, the improvement comprising:

said spaced members of said intermediate panel are transversely located within and closely adjacent to the spaced members of said first end panel and said spaced members of said second end panel are transversely located within and closely adjacent to the spaced members of said intermediate panel;

said panels are adapted to be arranged in a horizontal position engaging a floor wherein said slats are in the same plane to form a horizontal upper surface for said bed, said first end panel being a foot panel and said second end panel being a head panel of said bed;

when said article is configured as a lounge, said foot panel and said intermediate panel are adapted to be arranged in a horizontal position on said floor and said head panel is rotated about said hinge means to an upstanding position relative to said horizontal panels, said head panel being adjustably lockable in a desired angular position by lock means connected between the adjacent spaced longitudinal members of said head and intermediate panels;

when said article is configured as a chair, said foot panel is rotated about said pivot means so that the slats on said foot panel are substantially horizontal and facing downward to engage said floor and said intermediate panel is adapted to be arranged above said foot panel and the slats of said intermediate panel form a substantially horizontal upper seat surface of said chair, and said head panel is rotated about said hinge means to an upstanding position relative to said intermediate panel, said head panel being adjustable to a desired angular position wherein it is fixed by said lock means; and when said article is configured as a table, said head panel is adapted to be arranged in a horizontal position on said floor wherein the slats of said head panel form a horizontal upper surface above said floor, said intermediate panel is rotated on said hinge means so that the slats on said intermediate panel are positioned above and engaged downwardly against said upper surface, and said foot panel is rotated about said pivot means so that the slats on said foot panel are positioned above said head and intermediate panels to form a substantially horizontal upper surface for said table.

2. The invention of claim 1 further comprising a fourth panel which has a pair of spaced longitudinal members which are connected at least one transverse slot, said fourth panel being pivotally connected to the free end of said head panel, said spaced members of said fourth panel being transversely located within the spaced members of said head panel, and said fourth panel forming a bed head, which is in an upstanding position when said article is configured as a bed.

3. The invention of claim 2, wherein said fourth panel is constructed and arranged to interengage with said intermediate panel so that the four panels of said article are retained in relatively fixed positions when said article is configured as a table.

4. The invention of claim 2 wherein lock means are provided between said fourth panel and said head panel.

5. The invention of claim 1 wherein said lock means comprise apertures formed in the longitudinal members and pegs which are manually insertable into said apertures.

* * * * *